US005182997A

United States Patent [19]

Bardsley

[11] Patent Number: 5,182,997

[45] Date of Patent: Feb. 2, 1993

[54] TUFTING MACHINE YARN FEED ROLLER ASSEMBLY

[75] Inventor: Harold B. Bardsley, Nr. Chorley, England

[73] Assignee: Spencer Wright Industries, Inc., Dalton, Ga.

[21] Appl. No.: 787,063

[22] Filed: Nov. 4, 1991

[51] Int. Cl.[5] ..... D05C 15/18

[52] U.S. Cl. ..... 112/80.73; 112/302

[58] Field of Search ..... 112/80.01, 80.23, 80.7, 112/80.72, 80.73, 302; 66/146, 213, 133, 138; 403/121; 19/273, 274, 276; 28/193, 194, 258

[56] References Cited

U.S. PATENT DOCUMENTS

| | | | |
|---|---|---|---|
| 2,862,465 | 12/1958 | Card . | |
| 2,875,714 | 3/1959 | Nix . | |
| 2,966,866 | 1/1961 | Card . | |
| 3,001,388 | 9/1961 | MacCaffray, Jr. . | |
| 3,075,482 | 1/1963 | Card . | |
| 3,084,644 | 4/1963 | Card . | |
| 3,103,187 | 9/1963 | Hammel, Jr. . | |
| 3,134,529 | 5/1964 | Beasley . | |
| 3,160,125 | 12/1964 | Bryant et al. | 112/80.7 X |
| 3,272,163 | 9/1966 | Erwin, Jr. et al. . | |
| 3,375,797 | 4/1968 | Gaines | 112/80.73 X |
| 3.489,326 | 1/1970 | Singleton . | |
| 3,605,660 | 9/1971 | Short | 112/80.73 |
| 3,752,094 | 8/1973 | Short . | |
| 3,847,098 | 11/1974 | Hammel, Jr. . | |
| 3,926,132 | 12/1975 | Lear et al. . | |
| 3,955,514 | 5/1976 | Prichard et al. . | |
| 3,981,253 | 9/1976 | Neyraud | 112/80.73 |
| 4,134,348 | 1/1979 | Scott . | |
| 4,549,496 | 10/1985 | Kile | 112/80.08 |
| 4,608,935 | 9/1986 | Bardsley . | |
| 4,856,441 | 8/1989 | Kurata | 112/80.73 |
| 5,080,028 | 1/1992 | Ingram | 112/80.73 X |

*Primary Examiner*—Andrew M. Falik
*Assistant Examiner*—Paul C. Lewis
*Attorney, Agent, or Firm*—Alan Ruderman

[57] ABSTRACT

A yarn feed roller assembly for a tufting machine for selectively controlling the speed at which yarn is fed to each needle of the tufting machine so that different pile heights may be produced by each needle. The assembly has a pivotable control arm corresponding to each needle and carrying a pair of narrow width feed rollers. Each control arm is a thin plate so as to reduce the amount of space required and to permit each needle to be individually controlled. Each feed roller associated with an arm correponds to a different pile height and is adapted to engage and be driven by a corresponding drive roller rotatably driven from the tufting machine at a different speed from each other drive roller. A yarn strand directed to a corresponding needle is first guided between the drive rollers and the feed rollers of the control arm. Each control arm may be pivoted about a fulcrum to engage a selected feed roller with its corresponding drive roller to feed the yarn to the needles at a corresponding speed. The mounting of each control arm permits simple removal and replacement in the assembly for ease of maintenance.

20 Claims, 2 Drawing Sheets

TUFTING MACHINE YARN FEED ROLLER ASSEMBLY

BACKGROUND OF THE INVENTION

This invention relates to tufting machines, and more particularly to yarn feed roller pattern attachments having a plurality of feed rollers permitting each yarn end to be controlled individually thereby permitting a full repeat design across the full width of the tufting machine.

Wide use is made of yarn feed roller pattern attachments or assemblies for producing variations in pile height in tufted pile fabrics such as carpeting. Although other types of pattern attachments are used, such as those having slotted slats, the feed roller attachments are the most popular. Representative of such feed roller pattern assemblies are those disclosed in the following U.S. Pat. Nos. 2,862,465 to Card; 2,875,714 to Nix; 2,966,866 to Card; 3,001,388 to MacCaffray; 3,075,482 to Card; 3,103,187 to Hammel; 3,134,529 to Beasley; 3,272,163 to Erwin, et al; 3,375,797 to Gaines; 3,489,326 to Singleton; 3,605,660 to Short; 3,752,094 to Short; 3,847,098 to Hammel; 3,926,132 to Lear, et al; 3,955,514 to Prichard et al; 4,134,348 to Scott and 4,608,935 to Bardsley.

These assemblies include a plurality of yarn feed rollers which feed yarn to the needles of the tufting machine. Each of the feed rollers is selectively driven at one of a plurality of different speeds independently of the other feed rollers by means of clutches controlled by a pattern control. The amount of yarn supplied to the needles of the tufting machine is determined by the rotational speed of the feed rollers about which the yarn is wound, so that with a fixed needle stroke the amount of yarn supplied to each needle determines the pile height of the fabric produced. To create patterned pile effects the amount of yarn fed to the individual needles may be varied by driving the feed rollers selectively at the different speeds. As is well known in the art when less yarn is fed than required by the needle, yarn is pulled back or back-robbed from the previous stitch which then becomes a lower loop. Thus, high and low loops may be produced, or even three levels of loop when feed rollers of three different speeds are provided, and also cut and loop pile may be produced as described in Card U.S. Pat. No. 3,084,645.

Each needle receiving yarn from a given feed roller always produces a pile loop at the same height as that of the other needles receiving yarn from that roller and, therefore, the number of pattern repeats across the width of the work product is determined and limited by the number of needles receiving yarn from each roller. It is therefore clear that a limitation on the number of feed rollers restricts the carpet or rug designer to designs which repeat frequently across the width of the carpet or rug. Accordingly, it is desirable to have a pattern attachment with an increased number of feed rollers so that the number of repeats across the width of the product may be reduced, and ideally of such a number that substantially individual yarn end control may be possible. In that case a full repeat design, i.e., a design with no repeats across the full width of the machine, may be possible.

An additional reason for desiring an individual yarn end pattern attachment is that the utilization of feed roller attachments in the prior art necessitates the use of a tube bank such as that disclosed in Card U.S. Pat. No. 2,862,465 for directing the yarn fed from a particular feed roller to all the needles receiving yarn from that feed roller. Such a tube bank, of necessity, has long tubes and short tubes to direct the yarn to the various needles across the width of the machine. Because of this and because of the elasticity of the yarn the amount of yarn pull-back varies to the different needles. That is, there is a variation in the amount of pull-back for the yarns traveling the long path in the long tubes compared to the amount of pull-back for the yarns traveling the short path in the shorter tubes. Thus, for example, the pull-back in a short tube may require only one stitch when changing from high loop to a lower loop, while the pull-back in a long tube may require three stitches to make this change. Consequently, due to the variations resulting, certain patterns such as those having straight lines, e.g. checker boards, etc., cannot be produced aesthetically. A tube bank, however, would not be required with a pattern attachment having individual yarn end control.

The most successful prior art feed roller attachments have been those such as illustrated in the aforesaid Singlton, Hammel U.S. Pat. No. 3,847,098, Lear et al and Bardsley patents, in the first three of which rollers are journalled on driven shafts and electromagnetic clutch elements are mounted within the rollers for drivingly transmitting the rotation of the shaft to the rollers selectively, and in the latter patent electromagnetic clutch elements are mounted on drive shafts driven at different speeds and selectively actuated to gear the rollers to a selective shaft. Whether the electromagnetic clutches are within the rollers or are coupled to the rollers by gears, the rollers are relatively wide and therefore limits the number of rollers that can be utilized due to space limitations. Moreover, since these feed roller attachments comprise a large number of clutches, and since certain of the clutch elements have a relatively short life, frequent servicing of the roller units has been occasioned.

As aforesaid, due to space limitations prior art designs have not generally been adoptable to the large number of rollers required for individual yarn end control. The Scott, Gaines, Short, and Prichard et al patents were attempts toward this end. However, the Short and Prichard et al proposals necessitated complicated drive constructions while the Scott proposal was found impracticable and was not developed. The Gaines proposal is the closest prior art development to attaining single end control. This proposal, however, has only been used for sample machines which have relatively narrow widths because of the large number of moving parts resulting in a complicated and expensive attachment for a full width machine.

SUMMARY OF THE INVENTION

Consequently, it is primary object of the present invention to provide a yarn feed pattern assembly for a tufting machine the pattern assembly having extremely narrow feed rollers permitting individual yarn end control and thus full control of the pattern repeat across the width of the tufting machine.

It is another object of the present invention to provide a yarn feed pattern control assembly for a tufting machine wherein a plurality of narrow feed rollers may be carried on each of a multiplicity of movable arms, each arm being controllably actuated to move a selected one of the rollers carried thereon into driving engagement with a corresponding drive roller, each drive roller being driven at a different respective speed so that yarn guided between the feed rollers and the drive rollers may be driven at a speed corresponding to that of the selected roller to feed yarn to a prescribed needle.

It is a further object of the present invention to provide a yarn feed roller pattern assembly for a tufting machine having a multiplicity of control arms each of which is readily movable and replaceable about a fulcrum in the assembly, each arm carrying a plurality of feed rollers, each being selectively engageable with a corresponding drive roller to feed yarn to a particular needle at a speed determined by the speed of the drive roller, pivoting of the control arm about its fulcrum acting to select a drive roller and feed roller for driving yarn to said needle.

Accordingly, the present invention provides a yarn feed roller assembly, known in the art as a pattern attachment, for selectively controlling the speed at which yarn is fed to each needle of a tufting machine so that different pile heights may be produced by each needle, the assembly having a multiplicity of pivotable control arms each carrying a plurality of narrow width feed rollers. Each feed roller associated with an arm corresponds to a different pile height and has a corresponding drive roller rotatably driven at a different speed from each other drive roller. A strand of yarn received from a supply is guided to a needle between the drive rollers and the feed rollers of a corresponding control arm. Controllably pivoting the control arm about a fulcrum will engage one of the feed rollers with its corresponding drive roller to feed the yarn strand at a speed corresponding to that of the selected drive roller so that a needle receiving yarn therefrom produces a pile height corresponding to the speed at which the yarn is fed. Each control arm is a thin plate so that the width of the arm and the feed rollers carried thereon provide a narrow profile. This permits each control arm to feed yarn to a single needle. Therefore, the speed of each yarn strand, known in the art as a yarn end, is individually controlled so that a full repeat design may be produced across the full width of the tufting machine as the speed of yarn fed to each individual needle may be changed each successive stitch.

Each control arm also carries a journal member which may readily be engaged with and disengaged from a fixed fulcrum member fixed to means secured to the tufting machine, the fulcrum being received in the journal. In the event of a failure of a feed roller bearing or the like, the arm having the failed bearing may then readily be removed and replaced by a new or reconditioned control arm. Additionally, because the yarn is merely guided between the feed rollers and the drive rollers, the arm may be replaced without disturbing the yarn. Thus, only a minimum amount of tufting machine down-time is required to replace an arm and maintain the pattern assembly which, it may be pointed out, has no clutches requiring servicing.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figures 1, 2:
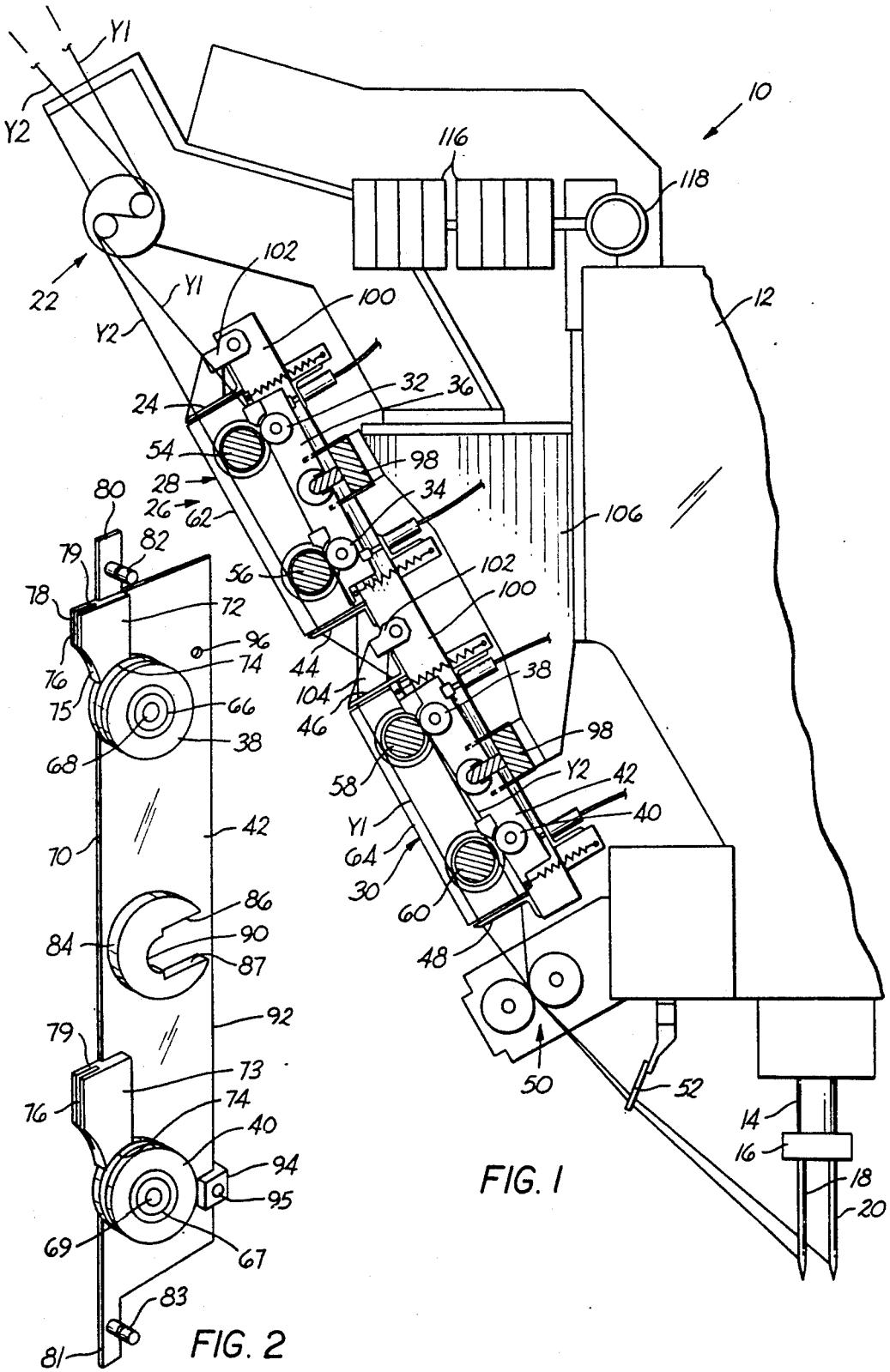
FIG. 1 is a fragmentary side elevational view partly in cross-section of a tufting machine incorporating a yarn feed roller assembly constructed in accordance with the principles of the present invention.
FIG. 2 is an enlarged perspective view illustrating one of the control arms of the yarn feed roller assembly.

Referring to the drawings, FIG. 1 illustrates a tufting machine 10 having a head 12 in which a plurality of transversely or laterally spaced push rods 14 (only one of which is illustrated) is reciprocably mounted, the push rods carrying a needle bar 16 at the lower ends thereof. The needle bar 16 supports needles 18, 20 which may be mounted in a single row, but which, as illustrated, are preferably mounted in a pair of spaced apart staggered rows and which cooperate in conventional manner with loopers or hooks (not illustrated) conventionally mounted beneath the head for cooperation with the needles as is notoriously well known in the art.

Yarn, such as strands Y1 and Y2, supplied from a yarn creel or the like (not illustrated) are guided about guide means 22 and through an apertured upper entry guide plate 24 to the yarn feed pattern assembly 26 forming the subject matter of the present invention. The assembly 26 is arranged for convenience and efficiency with an upper section 28 and a lower section 30, one of the sections, for example the upper section, feeding yarn to the front row of needles 18 and the other section feeding yarn to the rear row of needles 20. In this manner the assembly may be positioned on the front of the tufting machine to allow easy operator and maintenance access and yet be able to control each yarn strand or yarn end of the tufting machine. Thus, yarn strand Y1 may be controlled by yarn feed rollers 32, 34 associated with a control arm 36 of the upper section 28, while yarn strand Y2 may be controlled by yarn feed rollers 38, 40 associated with a control arm 42 of the lower section 30, as hereinafter described in detail. The yarn strand Y2 is by-passed about the feed rollers in the upper section while the yarn strand Y1 is by-passed about the feed rollers in the lower section. The yarn strands Y1 and Y2 are directed through an upper section apertured exit guide plate 44 to a lower section entry guide plate 46 from which the yarn strand Y2 is guided so as to be controlled by rollers 38, 40, while strand Y1 is guided to be by-passed about these rollers. The yarn strands exit the assembly through a lower section apertured guide plate 48 and after passing between the nip of conventional gear-type puller rolls 50 which put a slight pull thereon, are guided through a guide plate 52 to the respective needle.

Each of the upper and lower sections 28, 30 has a respective pair of drive rollers 54, 56 and 58, 60 extending transversely across the tufting machine journally supported in a plurality of upper and lower spaced apart brackets 62, 64 respectively, one of the drive rollers 54, 58 being driven by conventional means such as chain and sprocket means or gear means (not illustrated) from the tufting machine mainshaft at a first speed and acting through belt and pulley means (not illustrated) to drive the other drive roller at the same speed. Similarly the other set of drive rollers 56 and 60 are driven at a different and faster speed than the rollers 54, 58. The upper and lower sections 28, 30 of the assembly 26 each comprise a multiplicity of control arms such as the arms 36 and 42, and since each arm and its associated feed rollers are substantially identical and operate in the same manner, only one such control arm, i.e., a lower arm 42 is illustrated and described hereinafter in connection with FIGS. 2 through 4.

Referring to FIG. 2, each control arm 42 comprises a flat plate having a substantially rectangular configuration, the plate preferably being constructed from metal such as aluminum so as to minimize its weight. The feed rollers 38 and 40 are also formed from metal such as aluminum pressed onto the outer race of a respective bearing 66, 67 having the inner races pressed onto a respective stud shaft 68, 69 secured to the arm 42 so that each feed roller 38, 40 may freely rotate relative to the control arm 42. As illustrated, each roller is mounted with its periphery projecting slightly beyond an elongated edge 70 of the control arm so that it may engage the respective drive roller 58, 60 when and as desired as hereinafter described, the amount of projection of the periphery being such that engagement with the drive roller will not occur until desired.

Fixed on the control arm 42 adjacent to and above each roller and superposed over the edge 70 is a respective guide member 72, 73, each guide member having a substantially rectangular configuration but truncated to have a lower portion with a pair of joining concave edge surfaces 74, 75. Thus, the guide member has three straight edges and a pair of adjoining arcuate edges. The contour of the surface 74 corresponds substantially to that of the periphery of the feed rollers 38, 40 while the contour of the surface 75 corresponds substantially to the periphery of the drive rollers 58, 60 which, as illustrated in the drawings, have a slightly larger diameter than that of the feed rollers, the surfaces 74 and 75 permitting the guide members to be positioned closely to the rollers. The guide members 72, 73 are mounted such that a clearance space is provided between the feed rollers 38, 40 and the surfaces 74, and also such that a clearance space is provided between the drive rollers 58, 60 and the surfaces 75 when the arm 42 is pivoted to either engage the feed roller 38 with the drive roller 58 or the feed roller 40 with the drive roller 60 as hereinafter described. Additionally, the surface 75 has a slightly greater transverse thickness than the surface 74 by an amount substantially equal to the thickness of the control arm 42, which is approximately 1/32 inch, and a guide slot 76 is formed in the surface 75 and extends into the adjacent straight edge surface 78, extending partly through the top surface 79. The guide slot 76 is transversely disposed such that a yarn strand such as strand Y2 may be directed into the slot and guided thereby for contact with the peripheral surface of the feed rollers 38, 40.

Formed on the top and bottom of each control arm 42 are a pair of small fingers 80, 81 providing extensions of the arm along the edge 70, each finger having a respective pin 82, 83 for reasons which will hereinafter become clear. Attached to the arm 42 in the central portion thereof is a journal member 84 preferably formed from bearing material such as brass for forming a pivot journal for the arm 42. The member 84 in effect comprises a female member having a substantially C-shaped configuration, the limbs of which comprise vertically spaced apart surfaces 86, 87 between which a male member or finger 88 forming a fulcrum may be received, the member 88 having a convex leading edge 89 of a fragmentary circular form, i.e., a single radius, which is received within a conforming concave surface 90 of the member 84. The surfaces 86 and 87 as illustrated are spaced apart further than the radius of the surface 90 so that the member 84 and thus the arm 42 may pivot slightly in both directions relative to the member 88 without interference.

Also fastened to the arm 42 at and adjacent the edge 92 opposite the edge 70 is an abutment member 94, the member 94 of course being spaced from the member 84 to provide a force movement relative thereto when pushed as hereinafter described. On alternate arms 42 across the tufting machine the abutment members 94 are adjacent to and slightly below the feed roller 40 as illustrated in FIG. 2, while on the other arms the members 94 are adjacent to and above the feed rollers 38 as illustrated in FIG. 1, for example, in regard to the control arm 36 and feed roller 32 in the upper section, and the abutment illustrated in phantom in the lower section. The abutment members are attached to the arm by a rivet 95 and in this regard, since all of the control arms are identical for minimizing production costs, a hole 96 is illustrated in the arm 42 in FIG. 2 for receiving a rivet and thus an abutment member in place of the abutment member 94 if, for example, the control arm is one used adjacent to the one illustrated.

Each fulcrum 88 about which the journal 84 may pivot is secured to or formed on a respective bracket or rail 98 to which other brackets such as a bracket 100 illustrated in FIG. 1 are secured, the bracket 100 pivotably supporting a small arm 102 which in turn carries a member 104 to which the drive roller support brackets 62, 64 may be attached. The rails 98 and thus the entire assembly 26 may be fastened as an attachment to the head 12 of the tufting machine by means such as brackets 106 or similar means. By reason of the pivotable arms 102 the drive rolls may be pivoted upwardly to permit operator access for threading of the yarn through the assembly and the needles and for other maintenance operations.

Figure 4:
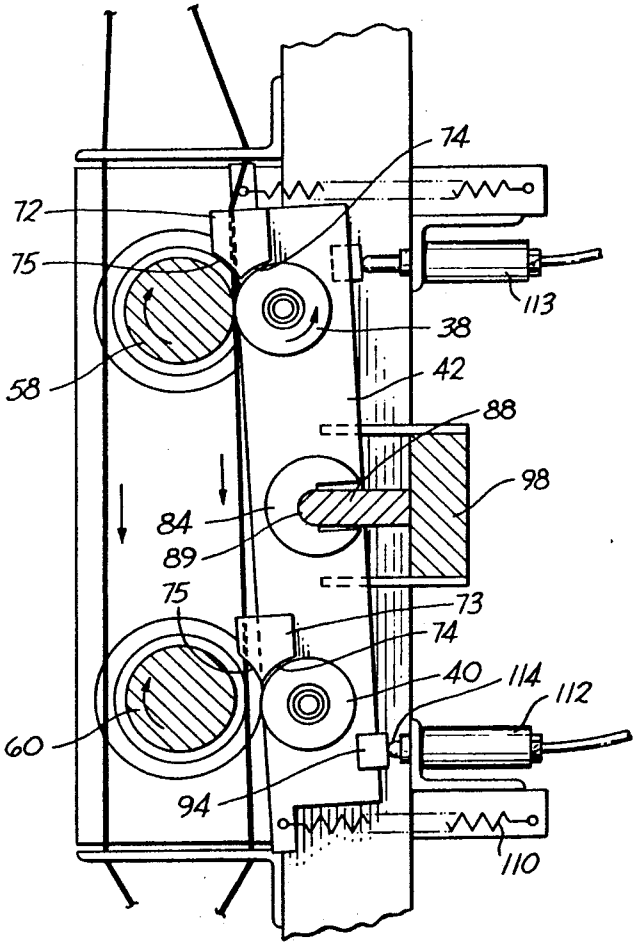
FIG. 4 is a view similar to FIG. 3 illustrating the position of the control arm to feed the yarn strand at a second speed.
Figure 3:
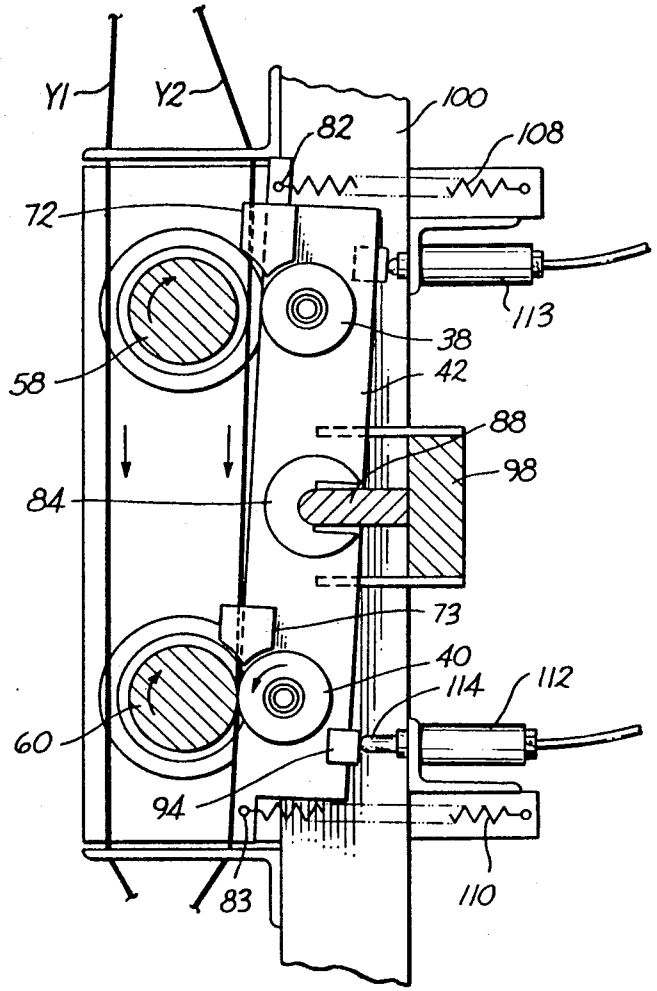
FIG. 3 is an enlarged fragmentary elevational view partly in section illustrating the position of a control arm to feed the yarn strand controlled thereby at a first speed.

As best illustrated in FIGS. 3 and 4 the control arm 42 is positioned adjacent the drive rolls 58, 60 by means of the fulcrum 88 seating in the concave surface 90 of the member 84, and is held by springs 108, 110 having one end respectively attached to the pins 82, 83 on the arm 42 and having their other ends attached to fixed means attached to the tufting machine. Additionally, a pneumatic cylinder 112 is supported by the bracket 100 or similar means at a location where its output plunger 114 may engage the abutment member 94. An adjacent cylinder, e.g., cylinder 113 is mounted in the alternate vertical position so as to engage the abutment member on an adjacent arm so that adjacent cylinders are vertically staggered to condense space. The spring 110 is stronger than the spring 108 so that normally the periphery of the upper yarn feed roller 38 frictionally engages the periphery of the slower rotating drive roll 58 and is driven thereby as illustrated in FIG. 4. When a signal to provide a greater amount of yarn to the needle associated with the arm 42 is transmitted to solenoid means 116 illustrated in FIG. 1, from a pattern control (not illustrated) which may be of any conventional type such as a microprocessor programmed with pattern information, communication may be opened from a high pressure air supply 118 to permit the air to to be fed to the cylinder 112. When this occurs, the output plunger 114 of the cylinder extends and pushes against the abutment member 94 to pivot the control arm 42 clockwise about the fulcrum to the position illustrated in FIG. 3 to frictionally engage the feed roller 40 with the drive roller 60, so as to be driven thereby, the yarn strand Y2 being therebetween. When a signal is supplied to close the communication from the air supply to the cylinder 112 the spring 110 acts to pull and pivot the control arm counter-clockwise to the position illustrated in FIG. 4 so that the feed roller 38 again engages the drive roller 58. Since the yarn strand Y2 is guided between the feed roller 38 and the drive roller 58, and between the feed roller 40 and the drive roller 60, when the rollers 38, 58 engage, the yarn is fed at the slow speed, and when the rollers 40, 60 engage the yarn is fed at the higher speed.

It should be clear that the present invention provides a yarn feed roller assembly having a multiplicity of control arms, each arm being a very thin plate which carries at least a pair of very narrow feed rollers. Thus, because of the minimum of space required, the assembly provides the capability of having one control arm for each needle of a tufting machine on which the assembly is attached. Accordingly, single yarn end control permitting each yarn end on the machine to be controlled is provided. Consequently, there may be a full repeat design across the full width of the tufting machine, i.e., the pattern transversely across the fabric need not be repeated. Furthermore, although the invention has been described in conjunction with control arms having two yarn feed rollers mounted thereon so as to provide either high or low pile effects by the control of each individual yarn, additional yarn feed rollers may be carried by each control arm and driven selectively by drive rollers driven at speeds other than a single high and single low speed so as to provide more than two pile heights produced by the tufting machine. Such variations and modifications of the invention disclosed herein are clearly within the skill of those in the art.

Additionally, it should be understood that the present yarn feed roller assembly may be readily maintained. For example, should a failure of an element such as the bearings 66, 67 occur, the control arm having the failed bearing may be readily removed from the assembly merely by pivoting the arms 102 together with the drive rolls upwardly and thereafter disconnecting the springs from the control arm and sliding the control arm outwardly from the fulcrum 88. A replacement control arm may thereafter be inserted and attached and the drive rollers rotated back into their operative position thereby resulting in a minimum of down-time in the event of a bearing or other failure.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A yarn feed roller assembly for a tufting machine comprising a plurality of drive rollers rotatably mounted transversely on said tufting machine and driven thereby at different respective speeds, a multiplicity of transversely spaced control arms, a plurality of yarn feed rollers each corresponding to a drive roller rotatably journalled on each control arm, support means for pivotably mounting each control arm adjacent said drive rollers for engagement of said feed rollers with a respective drive roller selectively, and means for selectively pivoting said control arms to frictionally engage a selected feed roller of each control arm with a respective drive roller for rotatably driving said selected feed roller of each control arm by the respective drive roller, whereby a yarn guided between the feed rollers of each control arm and the drive rollers will be frictionally engaged by and fed by the selected feed roller and its respective drive roller at a corresponding speed.

2. A yarn feed roller assembly as recited in claim 1, wherein said support means includes a journal member carried by each control arm, a fulcrum about which said journal member may pivot, and means for fixedly mounting said fulcrum on said tufting machine.

3. A yarn feed roller assembly as recited in claim 2, wherein said journal includes a concave recess conforming a circular arc and said fulcrum includes a convex surface conforming to the shape of said recess and received therein, whereby said journal may pivot on said fulcrum.

4. A control arm for a yarn feed roller assembly used for feeding yarn in a tufting machine comprising a substantially flat plate elongated in a longitudinal direction and having a substantially rectangular configuration, at least a pair of circular rollers journalled thereon at longitudinally spaced apart dispositions for rotation about a respective axis relative to said plate, the axis of each roller being adjacent to and spaced from one longitudinally extending edge of said plate a distance less than the radius of said rollers so that the periphery of each roller extends beyond said one edge, a mounting member secured to said plate at a disposition longitudinally intermediate said rollers, said mounting member having an open end slot for receiving a fulcrum through said slot on which said member may journally pivot when mounted in said assembly.

5. A control arm as recited in claim 4, wherein said mounting member has a substantially C-shaped configuration defining a pair of spaced apart planar surfaces and a concave recess intermediate said surfaces having a configuration conforming to the arc of a circle, the radius of said recess being less than the spacing between said surfaces.

6. A control arm as recited in claim 4, including a guide member corresponding to each roller, means for mounting each guide member adjacent a respective roller superposed over said one edge and having a projecting portion extending beyond said one edge, each guide member having a longitudinally extending yarn guide slot in said projecting portion.

7. A control arm as recited in claim 6, wherein each guide member has a concave surface adjacent to and spaced from the respective roller and a concave surface in said projecting portion.

8. A control arm as recited in claim 4, including an abutment member fixedly secured to said arm at a second longitudinally extending edge spaced from said one edge, said abutment member being longitudinally spaced relative to said mounting member.

9. A control arm as recited in claim 8, wherein said mounting member has a substantially C-shape configuration defining a pair of spaced apart planar surfaces and a concave recess intermediate said surfaces having a configuration conforming to the arc of a circle, the radius of said recess being less than the spacing between said surfaces.

10. A control arm as recited in claim 8, including a guide member corresponding to each roller, means for mounting each guide member adjacent a respective roller superposed over said one edge and having a projecting portion extending beyond said one edge, each guide member having a longitudinally extending yarn guide slot in said projecting portion.

11. A control arm as recited in claim 10, wherein each guide member has a concave surface adjacent to and spaced from the respective roller and a concave surface in said projecting portion.

12. A yarn feed roller assembly for a tufting machine comprising a frame secured to said tufting machine, a plurality of drive rollers mounted on said frame and driven by said tufting machine at different respective speeds, said drive rollers having axes of rotation extending transversely relative to said tufting machine, a multiplicity of spaced control arms, at least some of said arms being spaced transversely relative to said tufting machine, a plurality of yarn feed rollers each corresponding to a drive roller rotatably journalled about an axis on each control arm, said frame having support means including a fulcrum, a mounting member secured to said control arm spaced from said rollers for cooperating with said fulcrum for pivotably mounting each control arm adjacent said drive rollers for engagement of said feed rollers with a respective drive roller selectively, means for urging said control arms in a first direction about said fulcrum to frictionally engage a selected feed roller of each control arm with a respective drive roller for rotatably driving said selected feed roller thereby, and means for overcoming the urging of said control arm to pivot said control arm in an opposite direction relative to said fulcrum to disengage the first selected feed roller from the respective drive roller and to frictionally engage another feed roller of each arm with a different respective drive roller for rotatably driving said other feed roller of each arm at a different speed, whereby yarn guided between the feed rollers of each control arm and the drive rollers will be frictionally engaged by and fed by first one selected feed roller and then by another selected feed roller selectively.

13. A yarn feed roller assembly as recited in claim 12, wherein said control arms each comprise a substantially flat plate elongated in a longitudinal direction and a pair of spaced apart longitudinally extending edges, the axis of each roller being adjacent to and spaced from one longitudinally extending edge of said plate a distance less than the radius of said rollers so that the periphery of each roller extends beyond said one edge, a mounting member being secured to said control arm at a disposition longitudinally intermediate said rollers for receiving said fulcrum.

14. A yarn feed roller assembly as recited in claim 13, wherein said mounting member has a substantially C-shape configuration defining a pair of spaced apart planar surfaces and a concave recess intermediate said surfaces having a configuration conforming to the arc of a circle, the radius of said recess being less than the spacing between said surfaces.

15. A yarn feed roller assembly as recited in claim 13, including a guide member corresponding to each roller, means for mounting each guide member adjacent a respective roller superposed over said one edge and having a projecting portion extending beyond said one edge, each guide member having a longitudinally extending yarn guide slot in said projecting portion.

16. A yarn feed roller as recited in claim 15, wherein each guide member has a concave surface adjacent to and spaced from the respective roller and a concave surface in said projecting portion.

17. A yarn feed roller as recited in claim 13, including an abutment member secured to said arm at a second longitudinally extending edge spaced from said one edge, said abutment member being longitudinally spaced relative to said mounting member.

18. A yarn feed roller as recited in claim 17, wherein said mounting member has a substantially C-shape configuration defining a pair of spaced apart planar surfaces and a concave recess intermediate said surfaces having a configuration conforming to the arc of a circle, the radius of said recess being less than the spacing between said surfaces.

19. A yarn feed roller as recited in claim 17, including a guide member corresponding to each roller, means for mounting each guide member adjacent a respective roller superposed over said one edge and having a projecting portion extending beyond said one edge, each guide member having a longitudinally extending yarn guide slot in said projecting portion.

20. A yarn feed roller as recited in claim 19, wherein each guide member has a concave surface adjacent to and spaced from the respective roller and a concave surface in said projecting portion.

* * * * *